United States Patent [19]

DiFiore

[11] Patent Number: 4,877,350

[45] Date of Patent: Oct. 31, 1989

[54] FOUNDATION WATERPROOFING METHOD

[76] Inventor: Dante DiFiore, 5387 Wilson Mills Rd., Highland Hts., Ohio 44143

[21] Appl. No.: 262,731

[22] Filed: Oct. 26, 1988

[51] Int. Cl.[4] ..... E02B 11/00

[52] U.S. Cl. ..... 405/38; 405/36; 405/43; 52/169.5

[58] Field of Search ..... 52/169.5, 169.14; 405/36, 43, 45; 210/290

[56] References Cited

U.S. PATENT DOCUMENTS

| | | | |
|---|---|---|---|
| 4,045,964 | 9/1977 | Barclay | 52/169.5 X |
| 4,309,855 | 1/1982 | Pate et al. | 52/169.5 |
| 4,523,875 | 6/1985 | DiFiore | 405/50 |
| 4,733,989 | 3/1988 | Harriett | 405/43 |
| 4,745,716 | 5/1988 | Kuypers | 52/169.14 X |
| 4,783,261 | 11/1988 | Lingle | 210/290 |

OTHER PUBLICATIONS

"Stop Leaky Basements" Advertisement, DiFiore Waterproofing, Inc., Highland Heights, Ohio.

*Primary Examiner*—Randolph A. Reese

*Assistant Examiner*—Arlen L. Olsen

[57] ABSTRACT

A method for alleviating seepage of water through the foundation and/or into the basement of a building includes procedures for digging a trench along an exterior wall of the building's foundation, treating the exposed exterior wall surface to diminish its water permeability, providing a properly configured footer drain tile system for ducting water away from the footer of the foundation wall, and carefully filling the trench with an arrangement of selected materials that perform in a synergistic manner to achieve a desired combination of objectives. The footer drain tile system is positioned in the trench at a level below the top of the basement floor of the building. The materials used to fill the trench include a tiered arrangement of gradated stones, clay and topsoil. The stones define a porous reservoir and are arranged in a gradation of sizes, with the largest stones in lower portions of the trench and adjacent the footer drain tile. The top of the porous reservoir of gradated stone is capped by a densely packed layer of relatively impervious material such as clay. The sloped layer of clay is capped by a relatively porous fill of topsoil that also serves to close upper portions of the trench.

4 Claims, 1 Drawing Sheet

FOUNDATION WATERPROOFING METHOD

Attention is herewith drawn to U.S. Pat. No. 4,523,875 for AUXILLIARY DRAINAGE SYSTEM FOR ELIMINATING WATER PROBLEMS ASSOCIATED WITH A FOUNDATION OF A BUILDING, issued to Dante DiFiore June 18, 1985, the disclosure of which is herein incorporated by reference.

Reference is also made to the following patent, the disclosure of which is incorporated herein for its teaching of the best and most accepted technique utilized in present-day practice for thoroughly repairing and waterproofing hollow foundation walls of a building, and for preventing the recurrence of ground water problems associated with hollow foundation walls of a building, namely U.S. Pat. No. 4,136,500 issued Jan. 30, 1979 to Dante DiFiore, entitled BASEMENT WATERPROOFING SYSTEM.

BACKGROUND OF THE INVENTION

1. Field of the Invention

The present invention relates generally to a waterproofing system for relieving and eliminating water problems associated with the foundation of an existing building, and, more particularly, to a most preferred method for dealing with ground water problems in situations wherein a trench can be dug immediately adjacent an exterior surface of a foundation wall to expose its exterior surface.

2. Prior Art

Accepted conventional waterproofing techniques call for a trench to be dug carefully, usually by hand, immediately adjacent to the exterior surface of the foundation of a building to expose problematical wall portions, if not all of the foundation's exterior surface, for repair and treatment. The ditch is dug to a level that permits the building's footer drain tile system to be exposed for inspection, cleaning and repair. If the building has a basement floor, the ditch is dug to a level below that of the top of the basement floor of the building to expose and permit servicing of the building's footer drain tile system, and to assure that the footer drain tile is properly positioned below the level of the basement floor.

3. The Referenced U.S. Pat. No. 4,136,500

The disclosure of the referenced U.S. Pat. No. 4,136,500 is incorporated herein inasmuch as it presents the best and most accepted technique utilized in present-day practice for thoroughly repairing and waterproofing hollow foundation walls of an existing building, and for preventing the recurrence of ground water problems associated with hollow foundation walls of a building. The disclosure of the referenced U.S. Pat. No. 4,136,500 is also incorporated herein for its discussion of such techniques as are best employed in treating an exposed foundation with materials to diminish water penetrability, and of techniques that are preferably used in servicing and/or restructuring a footer drain tile system.

The referenced U.S. Pat. No. 4,136,500 relates to a method of overcoming the problem of water seeping into the basement of a dwelling or other building structure, whereby (1) hollow foundation walls are treated to fill its hollow spaces, especially hollow spaces in the vicinity of cracks or other structural damage or deterioration, (2) the footer drain line system of the building is serviced and restructured if need be to put it in proper form for trouble-free operation, (3) clean-outs are provided at spaced locations around the foundation for future checking and servicing of the footer drain line system, and (4) porous reservoirs are formed from particulate material such as stone in lower portions of the trenches or tunnels which have been dug about the foundation of the building. The porous reservoirs provide a system of open passages for ducting water to the footer drain line system, and for providing regions where water may temporarily accumulate harmlessly in a situation of heavy rainfall or backup of the storm drain line which serves the building.

The referenced U.S. Pat. No. 4,136,500 also discusses the advantages which can result from constructing a manhole at the juncture of the footer drain line system and the storm drain line that services a dwelling. In some situations it is desirable to install a check valve in the storm drain line at the location of the manhole to prevent water from backing up in the storm drain line and into the dwelling's footer drain line system. In other situations, it is desirable to have the footer drain line system discharge directly into the manhole, and to utilize a sump pump to transfer water from the manhole to the storm drain line.

While the waterproofing system disclosed in the referenced U.S. Pat. No. 4,136,500 continues to represent the most preferred approach to take in dealing with waterproofing problems where hollow building walls can be accessed by digging trenches immediately adjacent their exterior surfaces, there are situations where the digging of a trench immediately adjacent the exterior surface of a foundation wall is unduly expensive and/or would unacceptably require the removal or destruction of valuable foundation plantings or existing structures. Such a situation is addressed by the invention of the referenced U.S. Pat. No. 4,523,875.

4. The Referenced U.S. Pat. No. 4,523,875

The invention of the referenced U.S. Pat. No. 4,523,875 application relates to the use of an auxiliary drain line which is laid in a trench that extends about lower portions of the foundation of an existing building, but at locations preferably spaced several feet from the foundation. The newly laid auxiliary drain line is formed of perforate material (preferably perforated vitreous clay tile of about twelve inches in length laid end-to-end but spaced apart by distances within the range of about 1/16 inch to about ¼ inch) which admits surrounding ground water, and is connected to a storm drain line that serves the building so that water which enters the auxiliary drain line is discharged into the storm drain line.

The invention of the referenced U.S. Pat. No. 4,523,875 application further calls for a porous reservoir to be formed in the trench about the auxiliary drain line (1) to aid in ducting ground water to the auxiliary drain line, (2) to eliminate ground water pressure buildup in the vicinity of the foundation wall, and (3) to provide a ground water reservoir where water can harmlessly and temporarily accumulate in the situation of a heavy rainfall or backup of the storm drain line that serves the building. The presence of the porous reservoir that is defined by the stone serves to keep clay and other soils away from the foundation wall so that no medium is present adjacent the foundation wall that can retain ground water and enable a buildup of ground water pressure on the foundation wall. The reservoir also minimizes dampness of the foundation wall because, since ground water will travel under the influence of gravity downwardly through the open passages and interstices of the reservoir rather than horizontally across the reservoir, ground water does not tend to travel toward and come to rest adjacent the foundation wall, as would otherwise be the case if soil or clay were packed solidly against the outer surface of the foundation wall.

In situations where the building has a basement, the invention of the referenced U.S. Pat. No. 4,523,875 application calls for an auxiliary drain line to be laid in the trench at a level below the top of the basement floor of the building. In the event the storm drain line is found to be positioned too high to permit the auxiliary drain line to discharge into it properly, (1) a manhole is constructed, (2) the auxiliary drain line is connected to discharge into the manhole, (3) a sump pump is provided in the manhole for transferring water from the manhole to the storm drain line. Branch lines may be installed in short underground tunnels to connect the new auxiliary drain line with an existing footer drain line system which surrounds the foundation of the building. Additionally, the building's downspouts may be rerouted to the auxiliary drain line as may be needed to bypass clogged storm drain line sections. Moreover, the building's downspouts are preferably provided with specially configured leaf traps which may be cleaned out above ground level.

SUMMARY OF THE INVENTION

The present invention provides still another novel and improved method for relieving and eliminating water problems associated with a foundation of an existing building. The system of the present invention represents a further improvement on the waterproofing techniques described in the referenced patents, by providing methods which may be used in conjunction with or in substitution for the techniques described in the referenced patents.

In accordance with the preferred practice of the present invention, a method of relieving or eliminating water problems associated with the foundation of a building includes the steps of digging a trench immediately adjacent a foundation wall of a building, servicing, reconstructing or otherwise providing an operable footer drain tile system in the trench at a proper elevation, treating the exposed exterior wall surface as may be appropriate to repair cracks and/or to diminish the wall's water permeability, and filling the trench in a particularly advantageous manner using a novel arrangement or selected materials that significantly enhances the results of the waterproofing effort by helping to assure that water reaching the vicinity of the trench is prevented from coming into contact with and collecting along the exterior surface of the wall, and by providing a high capacity reservoir which can function to temporarily store excess ground wter in an emergency situation such as during an excessively heavy rainfall when the building's storm drain line may be incapable of immediately carrying away all of the accumulated ground water.

Lower portions of the trench are filled with a bed of porous material such as stones, with the top surface of the bed preferably being inclined downwardly as it extends outwardly from the foundation wall. The bed of porous material is covered by a capping layer of relatively impervious material such as packed clay, with at least the top surface of the densely packed clay being inclined downwardly as it extends outwardly from the foundation wall. The remainder of the upper portions of the trench are filled with topsoil.

The porous reservoir that is defined within lower portions of the trench serves (1) to duct ground water to the footer drain tile, (2) to eliminate ground water pressure buildup near the foundation wall, and (3) to provide a high capacity ground water reservoir that will act to harmlessly and temporarily store water during an excessively heavy rainfall when the building's storm drain line may not be immediately capable of carrying away all of the rainwater. An advantage of the porous reservoir is that the maze of interstices and interconnected passages that are provided therethrough serves to channel water expeditiously to the footer drain tile. Moreover, this maze of open passages does not freeze shut during winter; rather, it remains operable year round to eliminate and relieve water problems. A further advantage of the bed of porous material that it tends to cut off the flow of ground water to the vicinity of the foundation wall, and to duct this ground water expeditiously to the footer drain tile.

In preferred practice, a gradated arrangement of stones is used to form the porous reservoir, with the largest stones being positioned in lower portions of the trench and about the footer drain tile, and with progressively smaller stones being used to fill upper portions of the trench. The gradated arrangement of stones assures that a network of relatively large interstices and open passages will be provided in lower portions of the trench and about the footer drain tile to define a large capacity reservoir and to provide a highly effective open network that will not be subject to clogging, freezing or other problems that might render the network unable to duct ground water to the footer drain tile and/or to serve as a reservoir when needed. The provision of an array of progressively smaller stones to fill progressively higher portions of the trench provides a filter for trapping debris that might otherwise migrate into the network of large open passages that is provided by the larger stones in lowermost portions of the trench.

The relatively impervious capping layer of densely packed clay serves to direct water that is descending through the topsoil so that this water moves downwardly and outwardly along the incline of the relatively impervious clay layer toward the side of the trench that is farthest from the wall, i.e., away from the wall, so that this water tends to pass into the surrounding soil and/or to migrate into the porous reservoir from points of entry that are located near the outer edge of the trench. Such water as enters the porous reservoir is ducted expeditiously by the open network of the reservoir to the footer drain tile.

In situations where the building has a basement, the trench is dug to a depth below that of the basement floor of the building, and care is taken to assure that the footer drain tile system is laid in the trench at a level below the top of the basement floor of the building. This arrangement assures that any ground water which may be near the foundation will be carried away by the footer drain tile system before it reaches a height that will cause seepage into the basement.

In the event the building's storm drain line is found to be positioned too high to permit a properly positioned footer drain tile system to discharge into it, procedures described in the referenced U.S. Pat. No. 4,136,500 are preferably employed, namely, (1) a manhole is constructed, (2) the footer drain tile system is connected to discharge into the manhole, and (3) a sump pump is provided in the manhole for transferring water from the manhole to the storm drain line. In situations where there is a continuing problem with the storm drain line backing up, a check valve is preferably installed in the storm drain line to prevent it from backing up, as is described in the referenced U.S. Pat. No. 4,136,500.

BRIEF DESCRIPTION OF THE DRAWING

The foregoing and other features, and a fuller understanding of the invention, may be had by referring to the following description and claims taken in conjunction with the accompanying drawing, wherein:

DESCRIPTION OF THE PREFERRED EMBODIMENT

Figure 1:
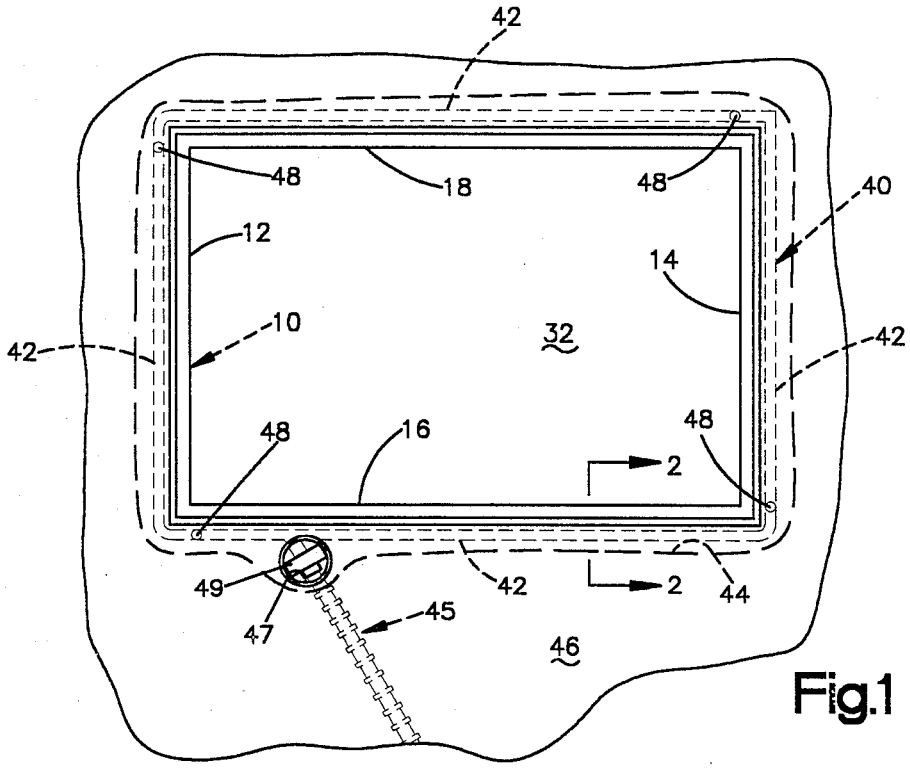
FIG. 1 is a top plan view of a foundation wall of a building and surrounding grounds, and showing the building's footer drain line system and a manhole containing a check valve installed in the building's storm drain line, with hidden portions thereof being shown by dotted lines; and, FIG. 2 is a sectional view, on an enlarged scale, as seen from a plane indicated by a line 2—2 in FIG. 1, depicting features of the preferred practice of the present invention.
Figure 2:
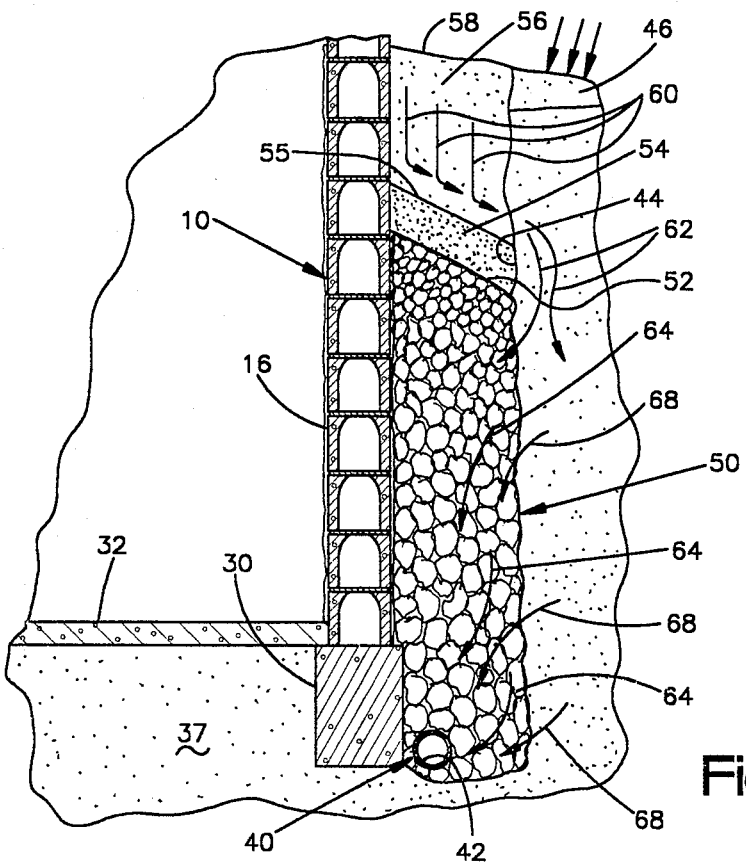

Referring to FIG. 1, a basement foundation wall of a dwelling or other type of building is indicated generally by the numeral 10. The foundation wall 10 includes sidewalls 12, 14, and front and back walls 16, 18. Referring to FIG. 2 which presents a typical section through the foundation wall 10, a poured concrete footer 30 underlies the wall 10. A poured concrete basement floor 32 has portions overlying the inner sides of the footer 30 and extending into abutting engagement with all portions of the foundation wall 10.

A footer drain tile system, indicated generally by the numeral 40, extends about the foundation footer 30. While the footer drain line system 40 is typically formed from a plurality of conventional, elongate drain tile 42 arranged end-to-end to establish a continuous conduit extending perimetrically around outer portions of the footer 30, it may be formed from other materials such as plastic conduit (not shown) which is perforated at spaced intervals to admit surrounding ground water. The footer drain tile system 40 is graded to drain, by gravity, into a storm drain line, indicated generally by the numeral 45 in FIG. 1.

The storm drain line 45 may connect with a city storm sewer (not shown), or may drain into a creek or onto a suitable watershed (not shown). In accordance with the teachings of the referenced U.S. Pat. No. 4,136,500, a manhole 47 and a backflow check valve 49 may be used in effecting connection of the footer drain tile system 40 with the storm drain line 45.

A trench 44 (indicated in FIG. 1 by a dotted line and in FIG. 2 by a solid line which marks a barrier between trench fill materials and surrounding soil) is dug in the ground 46 along such problematical foundation wall portions as are to be treated. While FIG. 1 depicts the trench 44 as extending about the entire perimeter of the foundation 10, it will be understood that the techniques of the present invention can be utilized to treat only one or a selected number of the walls 12, 14, 16, 18, or selected portions thereof.

If the building has a basement, as is the case with the building depicted in FIGS. 1 and 2, the trench 44 is dug to a depth that will access the building's footer drain tile system 40 and permit it to be serviced, cleaned, and repositioned if need be, as is described in detail in the referenced U.S. Pat. No. 4,136,500, to assure that the footer drain tile system 40 is laid below the level of the basement floor 32. Additionally, vertically-extending cleanout conduits 48 are preferably provided which connect with the footer drain line system 40, as is described in detail in the referenced U.S. Pat. No. 4,136,500.

While the trench 44 is open and the foundation wall 10 is exposed, the exterior surface of the foundation wall is cleaned, serviced to fill cracks, and is preferably coated with suitable conventional waterproofing materials such as cement, ironite, fine sand, and sealing materials such as liquid sealants and tar to inhibit water penetration therethrough. However, such servicing and/or coating is conventional in nature and therefore need not be described here in detail. The referenced U.S. Pat. No. 4,136,500 describes one such approach to wall treatment.

In accordance with the preferred practice of the present invention, lower portions of the trench 44 are filled with material such as slag or stone 50 to provide a bed of loose particulate that not only extends about the footer drain tile system 40, but also preferably fills the trench 44 to within a distance of about 1 to 3 feet of the top surface of the surrounding ground 46. In preferred practice, the material 50 is gradated stone, with the largest stones having diameters of about 2 to 4 inches and being positioned in lowermost portions of the trench 44 and about the drain tile 40. Progressively smaller gradated stones are used to fill progressively higher portions of the trench 44 so that the gradated stone fill provides a filter-like structure that will trap small debris in upper portions of the trench 44, and will thereby help to keep open the network provided by the interstices and passages among the stones that increase in size toward the bottom of the trench 44.

The top surface 52 of the porous bed 50 is preferably arranged at an angle of inclination, as depicted in FIG. 2, such that the top surface 52 slopes downwardly as it extends away from the foundation wall 10. Atop the bed of porous material 50, a capping layer 54 of relatively impervious material such as densely compacted clay is installed, and the remainder of the upper portions of the trench 44 are filled with topsoil 56. The top surface 55 of the densely packed layer of clay 54 is carefully constructed to assure that it inclines downwardly as it extends away from the associated foundation wall 10. In preferred practice, the angle of inclination of the top surface 55 as measured relative to the horizontal is within the range of about 20 to 40 degrees. The top surface 58 of the topsoil 56 slants at least slightly downwardly away from the foundation wall 20 to assist in channeling rain water away from the foundation 10.

The porous bed of particulate material 50 provides an intricate network of open passages that will serve to channel ground water from the vicinity of the foundation wall 10 into the footer drain tile system 40. Additionally, the porous bed 50 provides a reservoir within which ground water can be received and temporarily retained during a particularly intense storm when the capacity of the storm drain line 45 may be exceeded, and/or the storm drain line 45 may back up.

The inclined cap 54 of clay or other relatively impervious material is preferably at least about 4 inches thick, and preferably measures about 4 to 10 inches in thickness. The inclined upper surface 55 of the capping layer 54 serves to divert water that is traveling downwardly through the topsoil 56 so that this water is caused to travel downwardly and outwardly along the incline of the top surface 55, in directions away from the wall 10, as illustrated in FIG. 2 by arrows 60. This water tends to flow into the ground 46 that surrounds the trench 44, and/or along the outer wall of the trench 44 into the porous bed 50, as is indicated in FIG. 2 by arrows 62. Should this water enter the porous bed 50 as most of it will, the water will tend to travel downwardly through the open passages of the porous bed 50 to the footer drain tile system 40, as is indicated by arrows 64; such water will not tend to build up adjacent the foundation wall 10, nor will it tend to travel horizontally (in defiance of gravity) through the porous bed 50 toward the foundation wall 10. Similarly, ground water which enters the bed 50 from the surrounding soil 46 will be ducted to the drain tile system 40, as is indicated by arrows 68 in FIG. 2. Even in winter, the complex network of interstices and passages that are provided within the porous bed 50 will tend to remain open and functional.

While the foundation wall 10 is illustrated as being formed from conventional hollow concrete blocks, it will be understood that the wall 10 may be formed from other hollow materials such as tile, or may be partially or completely solid in character, as is the case where the wall 10 is formed from bricks or poured concrete. Neither the structure of the foundation wall 10 nor the construction of the footer drain line system 40 forms a part of the present invention, for the principles of the present invention are sufficiently versatile to permit their use in conjunction with practically all types of foundation wall constructions as well as with a wide variety of footer drain line system constructions.

As will be apparent from the foregoing description, the present invention provides a novel and improved system for relieving or eliminating water problems associated with the foundation of a building. The system of the invention requires the digging of a trench adjacent the exterior surface of a foundation wall, and provides a method of filling the trench that will minimize the possibility of a recurrence of water problems, especially where used in combination with such techniques as are described in the referenced U.S. Pat. No. 4,136,500.

Although the invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A method of relieving and eliminating ground water buildup near at least a portion of a foundation of a building, wherein the building is of the type that has a footer drain tile system extending along the base of its foundation, and has a basement floor that is located at a level above the base of the foundation, the method including the steps of:

(a) digging a trench extending along and adjacent the exterior of an underground wall which forms at least a portion of a foundation of a building, with the trench being dug to a depth extending along the base of the foundation and to a depth that is below the level of the basement floor of the building;

(b) servicing such portions of the foundation wall as are exposed by the trench to diminish water permeability of the wall;

(c) servicing such portions of the footer drain tile system of the building as are exposed by the trench to assure that the portion of the foundation that is exposed by the trench is provided with footer drain tile means that extends along the base of the trench at a level below that of the basement floor for ducting water from the base of the trench to a suitable drain;

(d) filling lower portions of the trench with a bed of gradated stone to provide a porous reservoir that extends from the building foundation to the outer wall of the trench and that surrounds the footer drain tile means and extends upwardly therefrom along a major portion of the height of the foundation wall portion for receiving ground water and ducting it to the footer drain tile means to prevent the buildup of ground water in the vicinity of the foundation wall portion, with the gradated stones being installed in the trench in an ordered array with the largest of the stones being positioned in lowermost portions of the trench and about the footer drain tile means, and with progressively smaller stones filling progressively higher portions of the trench;

(e) providing a capping layer of densely compacted clay atop the bed of gradated stone, with at least the upper surface of the capping layer slanting downwardly as it extends across the width of the trench in directions away from the foundation wall, with the angle of inclination of the upper surface thereof being inclined from the horizontal within the range of about 20 to about 40 degrees; and (f) filling remaining upper portions of the trench with topsoil, with the upper surface of the topsoil being inclined such that it slants downwardly as it extends across the width of the trench in directions away from the foundation wall.

2. The method of claim 1 wherein the step of filling lower portions of the trench with a bed of gradated stone includes filling the trench to within about 1 to 3 feet of its top with the gradated stone.

3. The method of claim 1 wherein the step of providing a capping layer of densely compacted clay includes the step of providing a capping layer thereof having a thickness measured vertically from the top of the bed of graduated stone of at least about 4 inches.

4. The method of claim 3 wherein the step of providing a capping layer includes providing a capping layer having a thickness within the range of about 4 to 10 inches of densely compacted clay.

* * * * *